US005894601A

United States Patent [19]

Henry

[11] Patent Number: 5,894,601

[45] Date of Patent: Apr. 20, 1999

[54] BABY MATE

[76] Inventor: Carlos W. Henry, 7900 Bellaire Blvd., #306, Houston, Tex. 77036

[21] Appl. No.: 09/010,558

[22] Filed: Jan. 22, 1998

[51] Int. Cl.[6] ..... A41D 11/00

[52] U.S. Cl. ..... 2/84; 2/69.5; 2/253

[58] Field of Search ..... 2/84, 253, 69.5; 5/413 R

[56] References Cited

U.S. PATENT DOCUMENTS 352,297 11/1886 Cohlman ..... 2/253

1,780,204 11/1930 Mastin ..... 2/253

4,158,892 6/1979 Gonzales ..... 2/84

*Primary Examiner*—Diana L. Biefeld

*Attorney, Agent, or Firm*—Patent & Trademark Services; Joseph H. McGlynn

[57] ABSTRACT

A carrying case for storing items used to care for an infant and which also serves to cover the infant. The case has a first section which contains a plurality of pockets for storing accessories used in caring for the infant, and a second section that has a hood that can be used to cover the infant's head.

10 Claims, 1 Drawing Sheet

BABY MATE

BACKGROUND OF THE INVENTION

This invention relates, in general, to carrying cases, and, in particular, to carrying cases that are designed to carry items associated with the care of babies.

DESCRIPTION OF THE PRIOR ART

In the prior art various types of cases have been proposed. For example, U.S. Pat. No. 4,566,130 to Coates discloses a diapering station formed of a single piece of material divided by fold lines into three sections to cushion an infant and to store accessories for diaper changing.

U.S. Pat. No. 4,886,150 to Fitzsimmons discloses a case for carrying accessories for feeding and changing babies having a central panel for changing babies covered by a releasable impermeable pad and pockets for holding accessories.

U.S. Pat. No. 5,215,172 to Stevenson discloses an infant care platform with two members hinged together to allow folding of the platform and in which the members are at the same height when opened.

U.S. Pat. No. 5,439,154 to Delligatti discloses a diaper bag having a plurality of pockets with a sealable flap for storing accessories.

SUMMARY OF THE INVENTION

The present invention is directed to a carrying case for storing items used to care for an infant and which also serves to cover the infant. The case has a first section which contains a plurality of pockets for storing accessories used in caring for the infant, and a second section that has a hood that can be used to cover the infant's head.

It is an object of the present invention to provide a combination carrying case and cover for an infant.

It Is an object of the present invention to provide a combination carrying case and cover for an infant in which a plurality of infant care items can be stored.

It is an object of the present invention to provide a combination carrying case and cover for an infant which can be used to cover the infant during transportation in a car seat.

These and other objects and advantages of the present invention will be fully apparent from the following description, when taken in connection with the annexed drawings.

DESCRIPTION OF THE PREFERRED EMBODIMENT

Figure 1:
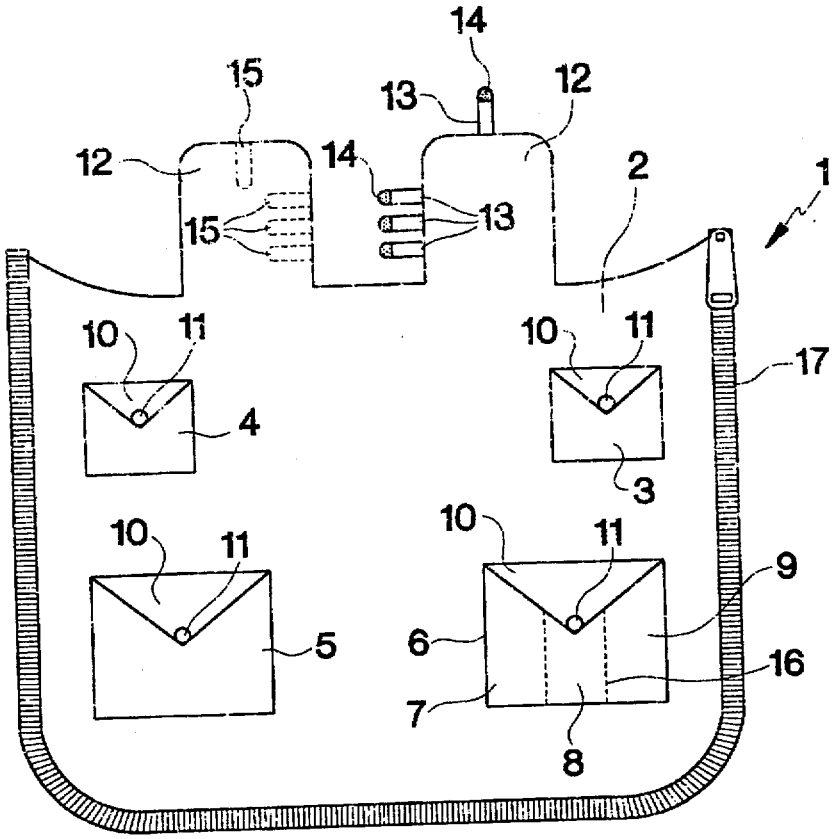
FIG. 1 is a plan view of the present invention.

Referring now to the drawings in greater detail, FIG. 1 shows the combination carrying case and baby cover 1 of the present invention. The combination carrying case and baby cover has a first main section 2 which can be made from any type of conventional material, although the material should be a relatively soft material that would not present an uncomfortable environment for the infant. Attached to this portion will be a plurality of pockets 3, 4, 5, 6. Each of the pockets has a flap 10 which will close the pocket and prevent any items in the pockets from falling out. The flaps can be held closed by any conventional fastener such as a snap 11. It should be noted that although the preferred fastener is a snap 11, other fasteners such as, but not limited to, Velcro hook and loop type fasteners could also be used without departing from the scope of the invention.

The pockets 3, 4, 5, 6 could be made in a variety of sizes to hold different items. For example the pockets 3, 4 could be relatively small to hold items such as baby wipes, pacifiers, etc., while the pockets 5, 6 could be made larger to hold larger items such as diapers and baby bottles. In addition, the pocket 6 has a plurality of dividers 16, of any conventional kind, which will divide the single pocket 6 into a plurality of smaller internal pockets 7, 8, 9 which will be sized to hold a plurality of baby bottles, or similar items.

At one edge of the main section 2 is a pair of semi-circular hood sections 12. These sections are shown in FIG. 1 in a flat condition so that the present invention can be laid flat in order to serve as a cover, which could be placed on a flat surface, and the baby laid thereon in order to change the baby. If the baby is being transported, for example in a car seat, the hood sections 12 could be secured together to make a hood that will cover the infant's head, thereby protecting the infant in cold and/or rainy weather.

Figure 2:
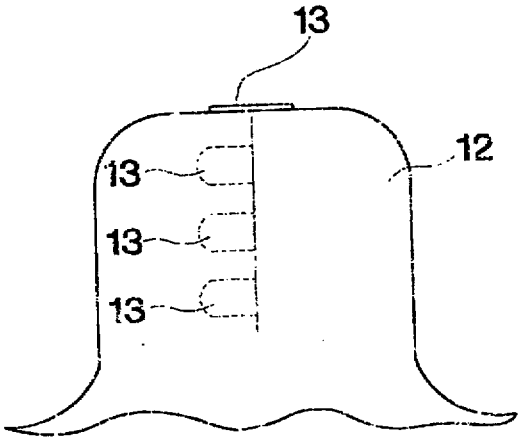
FIG. 2 is a front view of the hood portion of the present invention in a closed position.

In order to secure the hood sections 12 together, a plurality of tabs 13 are attached to one side of one of the hood sections 12. Each of the tabs 13 has a fastener such as, but not limited to, Velcro hook and loop type fasteners 14. The other hood section 12 would have a fastener 15 which would cooperate with the fasteners 14 on the tabs 13 to hold the hood sections together, as shown in FIG. 2.

In addition, the hood sections 12 have another pair of fasteners 13, 15 which will close the top of the hood when the present invention is used to transport the infant.

Although the Baby Mate and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A combination carrying case and baby cover comprising:

a piece of fabric having a first section, said first section having a top edge, a bottom edge and side edges, and front and back surfaces, said piece of fabric having a second section attached to said top edge of said first section, said first section having a plurality of pockets attached to one of said front and back surfaces, said second section comprising a pair of hood portions, said hood portions being attached adjacent each other at said top edge of said first section, each hood portion having fastening means for joining said hood portions together, and wherein said hood portions each have a top edge, a bottom edge and side edges, said fastening means are positioned on at least one of said side edges of each hood portion, and wherein said fastening means are positioned on said top edge of each hood portion.

2. The combination carrying case and baby cover as claimed in claim 1, wherein said pockets have flap means for closing said pockets.

3. The combination carrying case and baby cover as claimed in claim 2, wherein said flap means have fasteners for holding said flaps in a closed position.

4. The combination carrying case and baby cover as claimed in claim 1, wherein one of said pockets has a plurality of dividers to divide said one of said pockets into a plurality of pockets.

5. The combination carrying case and baby cover as claimed in claim 1, wherein said hood portions each have a top edge, a bottom edge and side edges, said fastening means are positioned on at least one of said side edges of each hood portion.

6. A combination carrying case and baby cover comprising:

a piece of fabric having a first section, said first section having a top edge, a bottom edge and side edges, and front and back surfaces, said piece of fabric having a second section attached to said top edge of said first section, said first section having a plurality of pockets attached to one of said front and back surfaces, said second section comprising a pair of hood portions, said hood portions being attached adjacent each other at said top edge of said first section, each hood portion having fastening means for joining said hood portions together, and wherein said side edges and said bottom edge have a fastener which extends completely around said side edges and said bottom edge, said fastener extends around one of said side edges, continues onto said bottom edge and then continues onto another of said side edges.

7. The combination carrying case and baby cover as claimed in claim 6, wherein said pockets have flap means for closing said pockets.

8. The combination carrying case and baby cover as claimed in claim 7, wherein said flap means have fasteners for holding said flaps in a closed position.

9. The combination carrying case and baby cover as claimed in claim 6, wherein one of said pockets has a plurality of dividers to divide said one of said pockets into a plurality of pockets.

10. The combination carrying case and baby cover as claimed in claim 6, wherein said hood portions each have a top edge, a bottom edge and side edges, said fastening means are positioned on at least one of said side edges of each hood portion.

* * * * *